US006065173A

United States Patent [19]

White

[11] Patent Number: 6,065,173

[45] Date of Patent: May 23, 2000

[54] CLEANING DEVICE FOR COPPER TUBING AND COPPER FITTINGS

[76] Inventor: John A White, 18 Twisting La., Wantagh, N.Y. 11793

[21] Appl. No.: 08/829,363

[22] Filed: Apr. 2, 1997

[51] Int. Cl.[7] ..... A46B 13/02

[52] U.S. Cl. ..... 15/88; 15/104.04; 15/104.95; 451/358; 451/462; 451/178

[58] Field of Search ..... 15/88, 104.03, 15/104.04, 104.05, 59, 104.09, 104.095; 451/344, 358, 461, 462, 66, 65, 178, 180

[56] References Cited

U.S. PATENT DOCUMENTS

| | | | |
|---|---|---|---|
| 1,723,009 | 8/1929 | Brackett | 144/28.5 |
| 2,635,393 | 4/1953 | Barth | 15/88 |
| 2,793,473 | 5/1957 | Hickman | 15/88 |
| 2,864,103 | 12/1958 | Gerber | 15/88 |
| 3,000,026 | 9/1961 | Prins et al. | 15/88 |
| 3,027,688 | 4/1962 | Zabransky | 15/88 |
| 3,067,443 | 12/1962 | Romens et al. | 15/88 |
| 4,238,867 | 12/1980 | Ruggero et al. | 15/88 |
| 5,056,265 | 10/1991 | Hurst | 15/104.04 |
| 5,157,802 | 10/1992 | Guidry et al. | 15/104.04 |
| 5,269,104 | 12/1993 | DiBiagio | 15/88 |
| 5,307,534 | 5/1994 | Miller | 15/104.05 |

*Primary Examiner*—Gary K. Graham
*Attorney, Agent, or Firm*—Michael I. Kroll

[57] ABSTRACT

A cleaning device (10) for copper tubing (12) and copper fittings (14) comprising an outside diameter brush assembly (16) to clean an outer surface of an end of a piece of copper tubing (12) and an inside diameter brush assembly (18) to clean an inner surface of a copper fitting (14). A structure (20) is for automatically rotating the outside diameter brush assembly (16) when the end of the piece of copper tubing (12) is inserted into the outside diameter brush assembly (16). A structure (22) is for automatically rotating the inside diameter brush assembly (18) when the copper fitting (14) is inserted over the inside diameter brush assembly (18). An assemblage (24) is for mounting the cleaning device (10) to a stationary object (26).

7 Claims, 6 Drawing Sheets

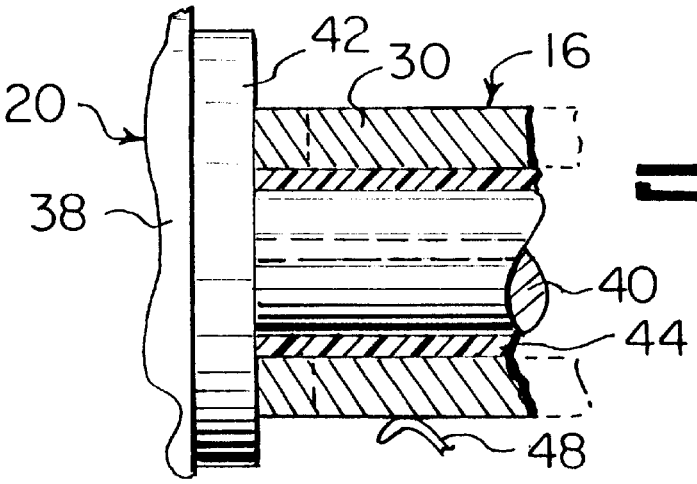
Fig. 6
Fig. 6a
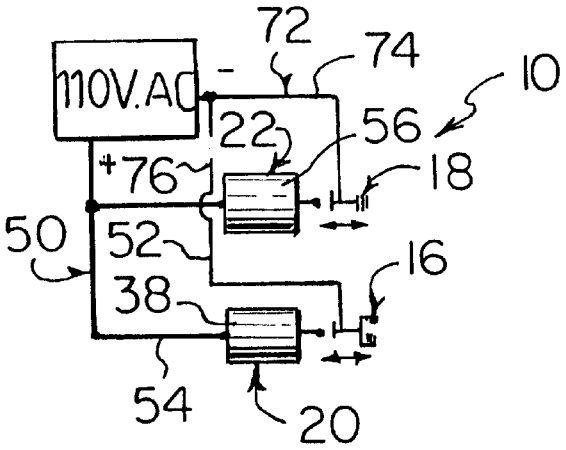

CLEANING DEVICE FOR COPPER TUBING AND COPPER FITTINGS

BACKGROUND OF THE INVENTION

1. Field of the Invention

The instant invention relates generally to copper tubing and fitting cleaning tools and more specifically it relates to a cleaning device for copper tubing and copper fittings. The cleaning device will automatically clean the outer surfaces of the ends of copper tubing and the inner surfaces of copper fittings, so that they can be soldered together.

2. Description of the Prior Art

Copper tubing is usually assembled by "sweating" or soldering. The copper tubing is inserted at one end into one end of a copper fitting. Solder is applied between the copper tubing and copper fitting. Upon being heated, the solder fills the space and is distributed by capillary attraction over the entire surface between the copper tubing and copper fitting. Copper fittings and copper tubing ends must be thoroughly clean before soldering. The old way is by using an emery cloth, a copper-fitting brush or by steel wool, which is less satisfactory but usable.

Numerous copper tubing and fitting cleaning tools have been provided in prior art that are adapted to be manually operated to prepare copper tubing and fittings for soldering. While these units may be suitable for the particular purpose to which they address, they would not be as suitable for the purposes of the present invention as heretofore described.

SUMMARY OF THE INVENTION

A primary object of the present invention is to provide a cleaning device for copper tubing and copper fittings that will overcome the shortcomings of the prior art devices.

Another object is to provide a cleaning device for copper tubing and copper fittings in which a pair of brushes rotatively activated by insertion of an end of a piece of copper tubing and a copper fitting will properly clean them for soldering.

An additional object is to provide a cleaning device for copper tubing and copper fittings in which the pair of brushes can be operated by one or two motors mounted on a bench or wall.

A further object is to provide a cleaning device for copper tubing and copper fittings that is simple and easy to use.

A still further object is to provide a cleaning device for copper tubing and copper fittings that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 6 is an enlarged view of a portion of FIG. 5 as indicated by arrow 6 in FIG. 5.

FIG. 6*a* is a schematic diagram of the electrical circuit of the first embodiment.

Figures 7, 7A, 8:
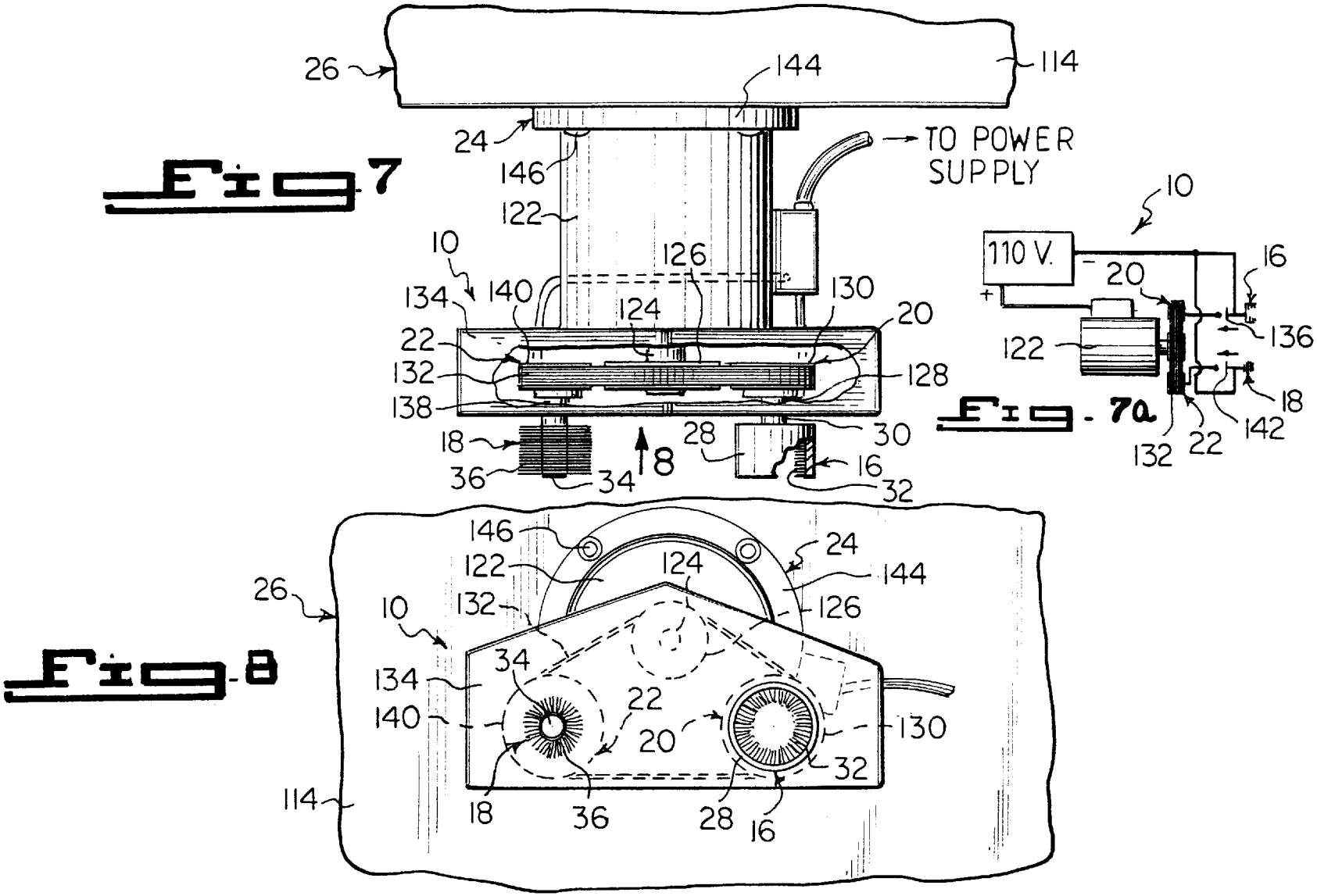

FIG. 7 is a top view of a third embodiment of the instant invention mounted on a wall with parts broken away in section.

FIG. 7*a* is a schematic diagram of the electrical circuit of the third embodiment.

FIG. 8 is a front view taken in the direction of arrow 8 in FIG. 7.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 8 illustrate a cleaning device 10 for copper tubing 12 and copper fittings 14, comprising an outside diameter brush assembly 16 to clean an outer surface of an end of a piece of copper tubing 12 and an inside diameter brush assembly 18 to clean an inner surface of a copper fitting 14. A structure 20 is for automatically rotating the outside diameter brush assembly 16, when the end of the piece of copper tubing 12 is inserted into the outside diameter brush assembly 16. A structure 22 is for automatically rotating the inside diameter brush assembly 18, when the copper fitting 14 is inserted over the inside diameter brush assembly 18. An assemblage 24 is for mounting the cleaning device 10 to a stationary object 26.

The outside diameter brush assembly 16 includes a cylindrical cap 28. A sleeve 30 extends from the cylindrical cap 28. A plurality of bristles 32 are radially positioned about an inner surface of the cylindrical cap 28. When the end of the piece of copper tubing 12 is inserted within the cylindrical cap 28, the bristles 32 will engage with the outer surface of the end of the piece of copper tubing 12.

The inside diameter brush assembly 18 consists of a hub 34 and a plurality of bristles 36 radially positioned about an outer surface of the hub 34. When the copper tubing 12 is inserted over the hub 34, the bristles 36 will engage with the inner surface of the copper fitting 14.

The first automatically rotating structure 20, as shown in FIGS. 1, 5, 6 and 6*a*, includes a first electric motor 38. A spindle 40 is rotatable by the first electric motor 38. A contact collar 42 is affixed onto the spindle 40 to rotate therewith. An insulator bushing 44 on the spindle 40 is longitudinally keyed to the sleeve 30. The sleeve 30 of the outside diameter brush assembly 16 can slide inwardly upon the insulator bushing 44, to engage with the contact collar 42.

A stationary cover 46 extends from the first electric motor 38 over a portion of the spindle 30, the contact collar 42, a portion of the insulator bushing 44 and a portion of the sleeve 30. A spring contact 48 is carried within the stationary cover 46 to engage with the sleeve 30. A power cord 50 has a first wire 52 connected to the spring contact 48 and a second wire 54 connected to the first electric motor 38. The sleeve 30 will engage with the contact collar 42, when the end of the piece of copper tubing 12 is inserted all the way into the outside diameter brush assembly 16, thereby closing an electric circuit and causing the spindle 40 to rotate the outside diameter brush assembly 16.

Figure 1:
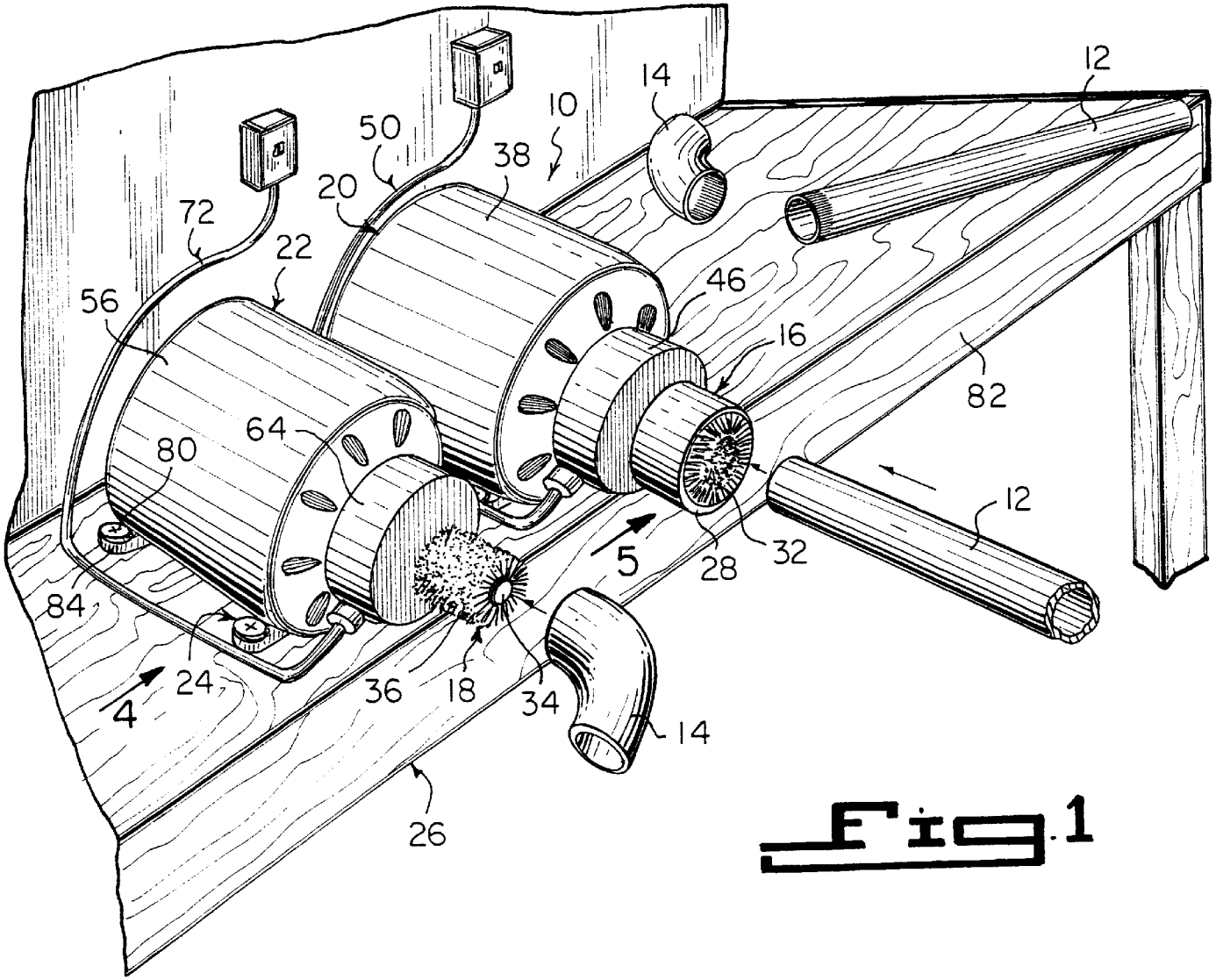
FIG. 1 is a perspective view of a first embodiment of the instant invention mounted on a bench.
Figure 4:
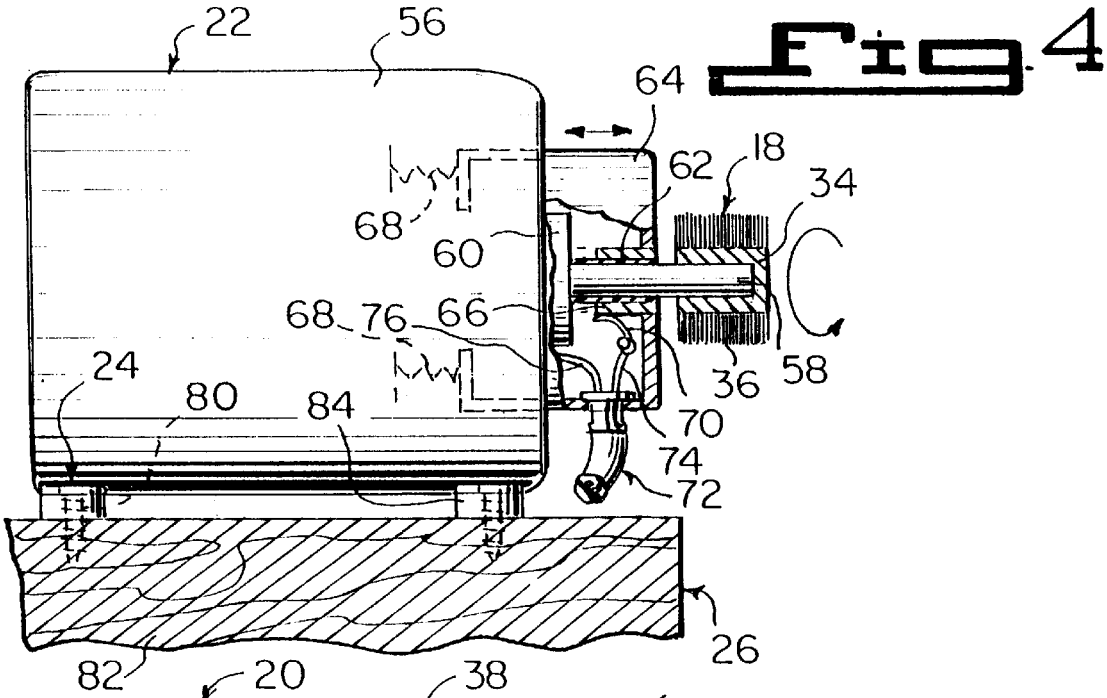
FIG. 4 is a side view taken in the direction of row 4 in FIG. 1, with parts broken away and in section.
Figure 5:
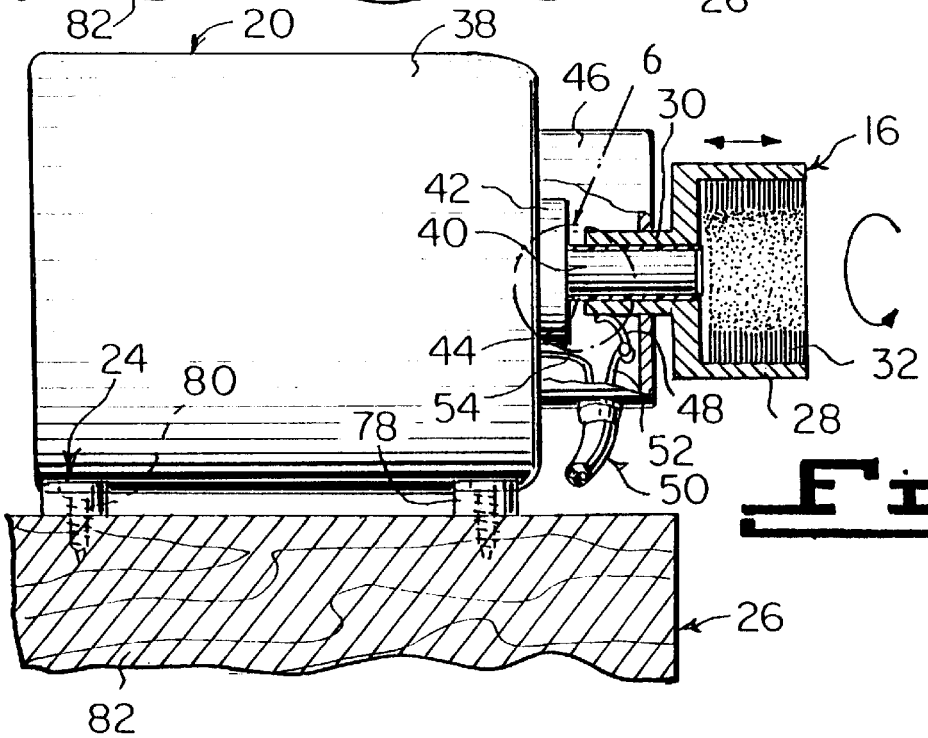
FIG. 5 is a side view taken in the direction of row 5 in FIG. 1, with parts broken away and in section.

The second automatically rotating structure 22, as shown in FIGS. 1, 4 and 6*a,* comprises a second electric motor 56. A spindle 58 is rotatable by the second electric motor 56. The spindle 58 has the hub 34 of the inside diameter bush assembly 18 removably affixed onto a free end thereof. A stationary contact collar 60 is affixed to the second electric motor 56 about the spindle 58. An insulator bushing 62 is on the spindle 58. A movable cover 64 extends from the second electric motor 56 over a portion of the spindle 58, the stationary contact collar 60 and the insulator bushing 62. A sleeve 66 is on the insulator bushing 62 and is affixed to the movable cover 64. A plurality of springs 68 are for normally biasing the movable cover 64 outwardly from the second electric motor 56.

A spring contact 70 is carried within the movable cover 64 to engage with the sleeve 66. A power cord 72 has a first wire 74 connected to the spring contact 70 and a second wire 76 connected to the second electric motor 56. The sleeve 66 on the movable cover 64 will engage with the stationary contact collar 60, when the copper fitting 14 is inserted all the way onto the inside diameter brush assembly 18, thereby closing an electric circuit and causing the spindle 58 to rotate the inside diameter brush assembly 18.

The mounting assemblage 24 includes a plurality of lugs 78 extending form the first electric motor 38. A screw 80 engages with one lug 78 and threads into the stationary object 26 being a bench 82, to retain the first electric motor 38 to the bench 82. A plurality of lugs 84 extend from the second electric motor 56. Each screw 80 can also engage with one lug 84 and thread into the stationary object 26 being the bench 82, to retain the second electric motor 56 to the bench 82.

Figure 2:
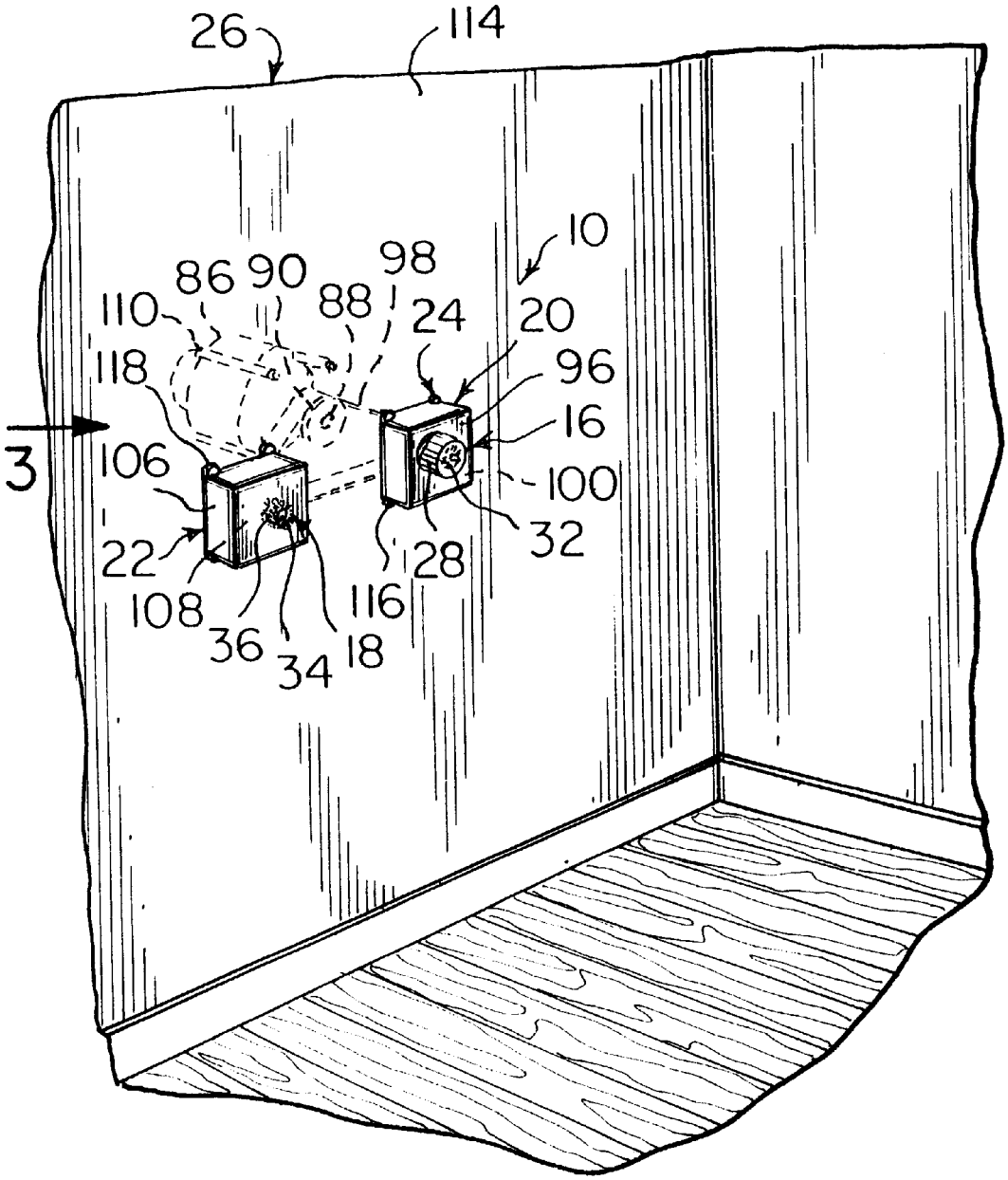
FIG. 2 is a front perspective of a second embodiment of the instant invention mounted through a wall.
Figure 3:
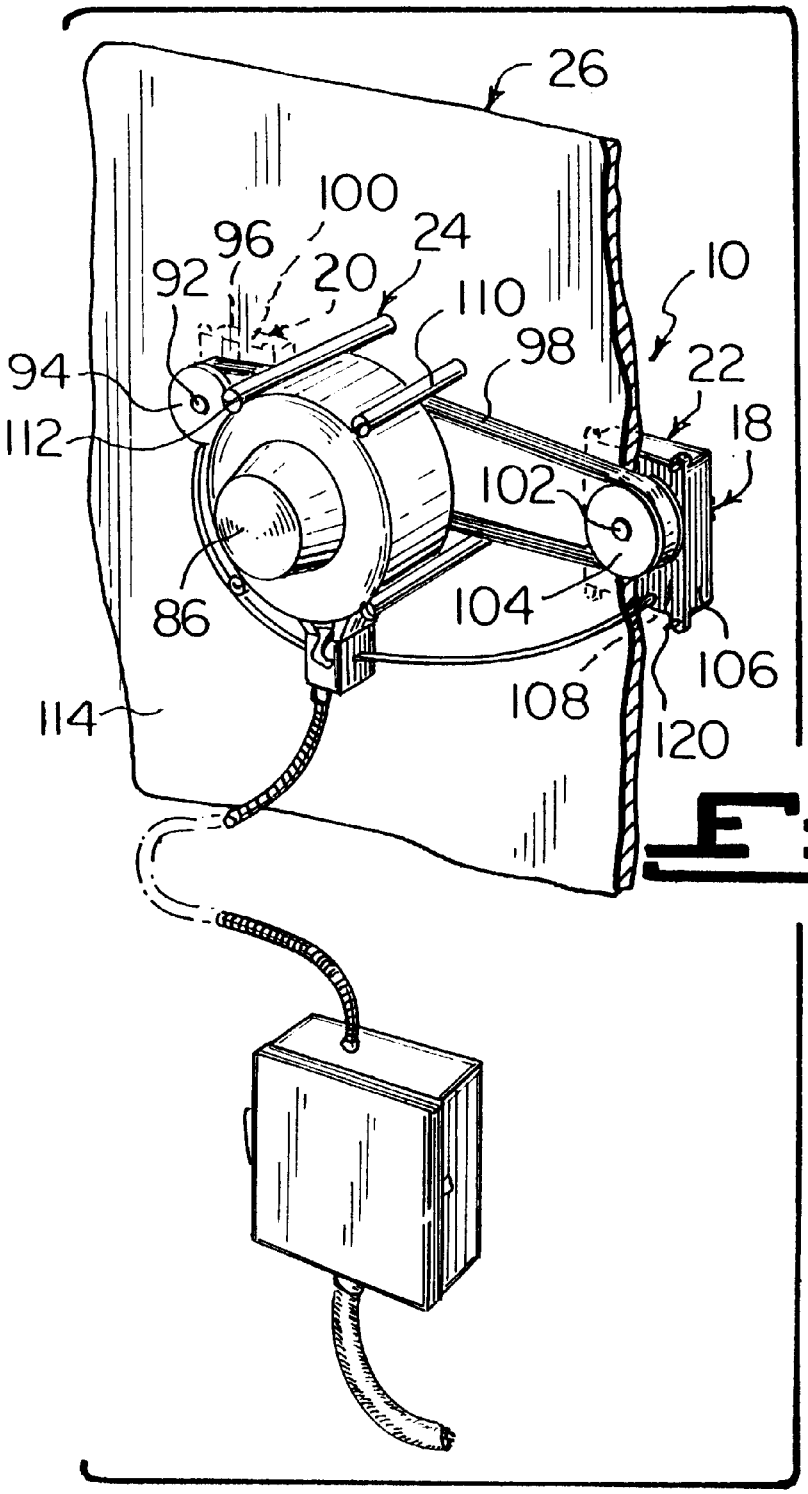
FIG. 3 is a rear perspective view taken in the direction of arrow 3 in FIG. 2, with part of the wall broken away and in section.

A second embodiment of the cleaning device 10 is shown in FIGS. 2 and 3, wherein the first automatically rotating structure 20 includes an electric motor 86. A spindle 88 is rotatable by the electric motor 86. A first pulley 90 is affixed onto the spindle 88 to rotate therewith. A first shaft 92 has a first end connected to the sleeve 30 of the outside diameter brush assembly 16. A second pulley 94 is affixed onto a second end of the first shaft 92 to rotate therewith. A first housing 96 is to carry in a rotatable manner the first shaft 92 therethrough. A continuous belt 98 extends between the first pulley 90 and the second pulley 94. A first switch 100 within the first housing 96 is activated by the outside diameter bush assembly 16, to operate the electric motor 86. When the end of the piece of copper tubing 12 is inserted all the way into the outside diameter brush assembly 16, an electric circuit will close, causing the outside diameter bush assembly 16 to rotate.

The second automatically rotating structure 22 consists of a second shaft 102 having a first end connected to the hub 34 of the inside diameter brush assembly 18. A third pulley 104 is affixed onto a second end of the second shaft 102 to rotate therewith. A second housing 106 carries in a rotatable manner the second shaft 102 therethrough with the continuous belt 98 extending between the first pulley 90, the second pulley 94 and the third pulley 104. a second switch 108 within the second housing 106 is activated by the inside diameter brush assembly 18, to operate the electric motor 86. When the copper fitting 14 is inserted over the hub 34 and electric circuit will close, causing the inside diameter brush assembly 18 to rotate.

The mounting assemblage 24 includes a plurality of elongated cylindrical connectors 110 extending from the electric motor 86. An elongated screw 112 engages with one elongated cylindrical connector 110 and threads into the stationary object 26 being a rear surface of a wall 114. A plurality of lugs 116 extends from the first housing 96. A plurality of lugs 118 extends from the second housing 106. A screw 120 engages with one lug 116 on the first housing 96 and the second housing 106 and threads into a front surface of the wall 114.

A third embodiment of the cleaning device 10 is shown in FIGS. 7, 7*a* and 8, wherein the first automatically rotating structure 20 includes an electric motor 122. A spindle 124 is rotatable by the electric motor 122. A first pulley 126 is affixed onto the spindle 124 to rotate therewith. A first shaft 128 has a first end connected to the sleeve 30 of the outside diameter brush assembly 16. A second pulley 130 is affixed onto a second end of the first shaft 128 to rotate therewith. A continuous belt 132 extends between the first pulley 126 and the second pulley 130. A housing 134 is affixed to the electric motor 122 to carry in a rotatable manner the spindle 124, the first pulley 126, the shaft 124, the second pulley 130 and the continuous belt 132. A first switch 136 within the housing 134 is activated by the outside diameter brush assembly 16, to operate the electric motor 122. When the end of the piece of copper tubing 12 is inserted all the way into the outside diameter brush assembly 16 an electric circuit will close, causing the outside diameter brush assembly 16 to rotate.

The second automatically rotating structure 22 consists of a second shaft 138 having a first end connected to the hub 34 of the inside diameter brush assembly 18. A third pulley 140 is affixed onto a second end of the second shaft 138 to rotate therewith. The second shaft 138 is carried in a rotatable manner within the housing 134, so that the continuous belt 132 now extends between the first pulley 126, the second pulley 130 and the third pulley 140. A second switch 142 within the housing 134 is activated by the inside diameter brush assembly 18 to operate the electric motor 122. When the copper fitting 14 is inserted over the hub 34 an electric circuit will close, causing the inside diameter brush assembly 18 to rotate.

The mounting assemblage 24 consists of a flange 144 extending about a rear portion of the electric motor 122. A plurality of fasteners 146 extend through the flange 144 and into the stationary object 26, being a front surface of the wall 114.

LIST OF REFERENCE NUMBERS

| | |
|---|---|
| 10 | cleaning device |
| 12 | copper tubing |
| 14 | copper fitting |
| 16 | outside diameter brush assembly of 10 |
| 18 | inside diameter brush assembly of 10 |
| 20 | first automatically rotating structure of 10 for 16 |
| 22 | second automatically rotating structure of 10 for 18 |

-continued

| | |
|---|---|
| 24 | mounting assemblage for 10 |
| 26 | stationary object |
| 28 | cylindrical cap of 16 |
| 30 | sleeve of 16 on 28 |
| 32 | bristle of 16 in 28 |
| 34 | hub of 18 |
| 36 | bristle of 18 on 34 |
| 38 | first electric motor of 20 |
| 40 | spindle of 20 on 38 |
| 42 | contact collar of 20 on 40 |
| 44 | insulator bushing of 20 on 40 |
| 46 | stationary cover of 20 |
| 48 | spring contact of 20 in 46 |
| 50 | power cord of 20 |
| 52 | first wire of 50 connected to 48 |
| 54 | second wire of 50 connected to 38 |
| 56 | second electric motor of 22 |
| 58 | spindle of 22 on 56 |
| 60 | stationary contact collar of 22 on 56 |
| 62 | insulator bushing of 22 on 58 |
| 64 | movable cover of 22 |
| 66 | sleeve of 22 on 64 |
| 68 | spring of 22 for 64 |
| 70 | spring contact of 22 in 64 |
| 72 | power cord |
| 74 | first wire of 72 |
| 76 | second wire of 72 |
| 78 | lug of 24 on 38 |
| 80 | screw of 24 in 78 |
| 82 | bench for 26 |
| 84 | lug of 24 on 56 |
| 86 | electric motor of 20 |
| 88 | spindle of 20 on 86 |
| 90 | first pulley of 20 on 88 |
| 92 | first shaft of 20 connected to 30 |
| 94 | second pulley of 20 on 92 |
| 96 | first housing of 20 |
| 98 | continuous belt of 20 |
| 100 | first switch of 20 in 96 |
| 102 | second shaft of 22 connected to 34 |
| 104 | third pulley of 22 on 102 |
| 106 | second housing of 22 |
| 108 | second switch of 22 in 106 |
| 110 | elongated cylindrical connector of 24 on 86 |
| 112 | elongated screw of 24 in 110 and 26 |
| 114 | wall for 26 |
| 116 | lug of 24 on 96 |
| 118 | lug of 24 on 106 |
| 120 | screw of 24 in 96, 106 and 114 |
| 122 | an electric motor of 20 |
| 124 | spindle of 20 on 122 |
| 126 | first pulley of 20 on 124 |
| 128 | first shaft of 20 connected to 30 |
| 130 | second pulley of 20 on 128 |
| 132 | continuous belt of 20 |
| 134 | housing of 20 on 122 |
| 136 | first switch of 20 in 134 |
| 138 | second shaft of 22 connected to 34 |
| 140 | third pulley of 22 on 138 |
| 142 | second switch of 22 in 134 |
| 144 | flange of 24 on 122 |
| 146 | fastener of 24 in 144 |

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A cleaning device for copper tubing and copper fittings comprising:

a) an outside diameter brush assembly to clean an outer surface of an end of a piece of copper tubing, including:
   i) a cylindrical cap;
   ii) a sleeve extending from said cylindrical cap; and
   iii) a plurality of bristles radially positioned about an inner surface of said cylindrical cap, so that when the end of the piece of copper tubing is inserted within said cylindrical cap, said bristles will engage with the outer surface of the end of the piece of copper tubing;

b) an inside diameter brush assembly to clean an inner surface of a copper fitting;

c) first means for automatically rotating said outside diameter brush assembly when the end of the piece of copper tubing is inserted into said outside diameter brush assembly, said first automatically rotating means including:
   i) a first electric motor;
   ii) a spindle rotatable by said first electric motor;
   iii) a contact collar affixed onto said spindle to rotate therewith;
   iv) an insulator bushing on said spindle longitudinally keyed to said sleeve, so that said sleeve of said outside diameter brush assembly can slide inwardly upon said insulator bushing to engage with said contact collar;
   v) a stationary cover extending from said first electric motor over a portion of said spindle, said contact collar, a portion of said insulator bushing and a portion of said sleeve;
   vi) a spring contact carried within said stationary cover to engage with said sleeve; and
   vii) a power cord having a first wire connected to said spring contact and a second wire connected to said first electric motor, so that said sleeve will engage with said contact collar when the end of the piece of copper tubing is inserted all the way into said outside diameter brush assembly, thereby closing an electric circuit and causing said spindle to rotate said outside diameter brush assembly;

d) second means for automatically rotating said inside diameter brush assembly when the copper fitting is inserted over said inside diameter brush assembly; and e) means for mounting said cleaning device to a stationary object.

2. A cleaning device as recited in claim 1, wherein said inside diameter brush assembly includes:

a) a hub; and b) a plurality of bristles radially positioned about an outer surface of said hub, so that when the copper tubing is inserted over said hub said bristles will engage with the inner surface of the copper fitting.

3. A cleaning device as recited in claim 2, wherein said second automatically rotating means includes:

a) a second electric motor;

b) a spindle rotatable by said second electric motor, said spindle having said hub of said inside diameter bush assembly removably affixed onto a free end thereof;

c) a stationary contact collar affixed to said second electric motor about said spindle;

d) an insulator bushing on said spindle;

e) a movable cover extending from said second electric motor over a portion of said spindle, said stationary contact collar and said insulator bushing;

f) a sleeve on said insulator bushing and affixed to said movable cover;

g) a plurality of springs for normally biasing said movable cover outwardly from said second electric motor;

h) a spring contact carried within said movable cover to engage with said sleeve;

and i) a power cord having a first wire connected to said spring contact and a second wire connected to said second electric motor, so that said sleeve on said movable cover will engage with said stationary contact collar when the copper fitting is inserted all the way onto said inside diameter brush assembly, thereby closing an electric circuit and causing said spindle to rotate said inside diameter brush assembly.

4. A cleaning device as recited in claim 3, wherein said mounting means includes:

a) a plurality of lugs extending from said second electric motor; and b) a plurality of screws, whereby each said screw can engage with one said lug and thread into the stationary object, being a bench, to retain said second electric motor to the bench.

5. A cleaning device as recited in claim 3, wherein said mounting means includes:

a) a plurality of lugs extending from said first electric motor; and b) a first plurality of screws, whereby each said screw thereof engages with one said lug and threads into the stationary object, being a bench, to retain said first electric motor to the bench.

6. A cleaning device as recited in 5, wherein said mounting means includes:

a) a plurality of lugs extending from said second electric motor; and b) a second plurality of screws, whereby each said screw thereof can engage with one said lug and thread into the stationary object, being a bench, to retain said second electric motor to the bench.

7. A cleaning device as recited in claim 1, wherein said mounting means includes:

a) a plurality of lugs extending from said first electric motor; and b) a plurality of screws, whereby each said screw engages with one said lug and threads into the stationary object, being a bench, to retain said first electric motor to the bench.

* * * * *